US006478354B1

(12) United States Patent
Eyal

(10) Patent No.: US 6,478,354 B1
(45) Date of Patent: Nov. 12, 2002

(54) SYSTEM AND METHOD FOR PACKING AND TRANSPORTING SHEET MATERIALS

(76) Inventor: Moshe Eyal, P.O. Box 1670, Caesarea (IL)

( * ) Notice: Subject to any disclaimer, the term of this patent is extended or adjusted under 35 U.S.C. 154(b) by 0 days.

(21) Appl. No.: 09/508,503

(22) PCT Filed: Sep. 23, 1998

(86) PCT No.: PCT/IL98/00459

§ 371 (c)(1),
(2), (4) Date: May 25, 2000

(87) PCT Pub. No.: WO99/15430

PCT Pub. Date: Apr. 1, 1999

(30) Foreign Application Priority Data

Sep. 25, 1997 (IL) ..... 121840

(51) Int. Cl.[7] ..... B65D 59/00; B65D 85/48
(52) U.S. Cl. ..... 294/74; 206/453
(58) Field of Search ..... 294/67.1, 67.4, 294/67.41, 74; 108/55.1; 206/453, 586, 597; 410/41, 99

(56) References Cited

U.S. PATENT DOCUMENTS

| | | | | |
|---|---|---|---|---|
| 1,690,873 A | | 11/1928 | O'Neil | |
| 2,004,626 A | | 6/1935 | Hann | |
| 2,631,723 A | | 3/1953 | Ellsworth | |
| 2,792,252 A | * | 5/1957 | Ernst | 294/74 |
| 3,203,726 A | * | 8/1965 | Smith | 294/74 |
| 3,302,782 A | * | 2/1967 | Pezely | 206/453 |
| 3,493,128 A | * | 2/1970 | Silvert | 294/67.4 X |
| 3,838,779 A | | 10/1974 | Dawson | |
| 4,063,702 A | * | 12/1977 | Wilde et al. | 206/453 X |
| 4,101,109 A | * | 7/1978 | Edwards | 294/74 X |
| 4,201,138 A | | 5/1980 | Cox | |
| 4,265,184 A | | 5/1981 | Cox | |
| 4,287,990 A | | 9/1981 | Kurick | |
| 4,292,901 A | * | 10/1981 | Cox | 206/453 X |
| 4,320,836 A | | 3/1982 | Brown | |
| 4,842,914 A | | 6/1989 | Franke | |
| 4,951,821 A | * | 8/1990 | Kempkes | 206/453 |
| 5,388,696 A | | 2/1995 | Rodriguez Egana | |
| 5,518,348 A | * | 5/1996 | Tucker | 410/99 |
| 5,678,691 A | | 10/1997 | Amado-Aguilar | |

FOREIGN PATENT DOCUMENTS

| | | | | |
|---|---|---|---|---|
| DE | 3701293 | * | 4/1988 | 206/453 |
| DE | 9313315 | * | 12/1993 | 206/453 |
| EP | 0270512 | | 8/1988 | |
| EP | 570614 | * | 11/1993 | 206/453 |
| FR | 2691435 | * | 11/1993 | 206/453 |
| GB | 2311278 | * | 9/1997 | 206/453 |

* cited by examiner

*Primary Examiner*—Johnny D. Cherry
(74) *Attorney, Agent, or Firm*—Dennison, Schultz & Dougherty

(57) ABSTRACT

The present invention refers to a system for packing, storing and transporting, particularly in a vertical position, stacks of sheet material such as glass, metal, plastic and large marble plates. The invention provides, for use in packing, storing and transporting sheet material, a sheet material protecting unit including two complementary protecting elements, each including a substantially planar surface for engaging a surface of the sheet material and at least one coupling element for coupling the two protecting elements about the sheet material, wherein the sheet material protecting unit is characterized in that the coupling element is of adjustable length which can be shortened on site during packing according to the thickness of the packed sheet material.

26 Claims, 7 Drawing Sheets

SYSTEM AND METHOD FOR PACKING AND TRANSPORTING SHEET MATERIALS

FIELD OF THE INVENTION

The present invention relates to a system and method for packing and transporting stacks of sheets, in particular, sheets made of fragile material.

BACKGROUND OF THE INVENTION

Conventional transportation of sheet material involves arranging the sheets together, tying them with a rope or a harness and loading them on the back of a transporter or inside a container. Sometimes the sheets are first packed into a crate or a wooden box before transporting them. When delicate or fragile sheets, such as glass panes are to be transported, they can not be transported lying down but must be transported in an upright position. Conventional methods for transporting such sheets are cumbersome and not always effective in providing safe transportation. Many difficulties arise because of the way the sheets are packed for transportation and the delicacy of the material.

Conventional methods of transporting and storing glass sheets are problematic mostly due to occurrence of abrasion, denting, and other forms of damage to unprotected edges, especially corners. In addition, sheets which are loosely packaged in crates can hit one another, causing cracking and breakage.

The following patents suggest devices which attempt to solve these problem is: O'Niel in U.S. Pat. No. 1,690,873 discloses a packing device for metal sheets which includes a supporting base having lugs receiving legs to receive a tie. U.S. Pat. Nos. 2,004,626 to Hann, 2,631,723 to Ellsworth, 3,203,726 to Smith and 5,519,348 to Tucker all teach corner or edge protectors for packaging sheet materials. Smith's corner protectors also cooperate with hoist elements. U.S. Pat. No. 4,101,109 to Edwards shows a harness for a loudspeaker which includes corner pocket members.

In order to use these conventional corner protectors, one must have a large supply of many sizes so that one can find the propel corner protector that fits the particular thickness of a stack of sheets to be transported or stored. Partially relating to this problem, Cox in U.S. Pat. Nos. 4,201,138 and 4,265,184 teaches a corner board for pallets which includes a corner board cap and a filler section for loads of different heights.

In short, it would be very desirable to have adjustable protecting units, which can be easily modified to the specific thickness of any stack of sheets of any variety of dimension and weight, and which can cooperate with hoist equipment.

The present invention aims at providing a novel system for packing, storing and transporting sheet material which is efficient, safe and simple to use, and which includes modular protecting units which are easily adjusted to the desired thickness of a sheet stack to be transported.

Further object of the present invention is to provide a packing and transporting system for use with conventional strapping and/or harnesses and common hoist, crane or forklift.

Another object of the present invention is to provide a substitute system for the common wood-based crates or metal L-shaped or A-shaped frames used in the glass industry to pack, store and transport large stocks of glass sheets. The system of this invention can be also used for packing and transporting sheets of plastics, large marble plates or any other sheets or plates.

Yet another object of the present invention is to provide a packaging method which uses these protecting units for improved secured transportation and storage of sheet material.

SUMMARY OF THE INVENTION

The present invention refers to a system for packing, storing and transporting, particularly in a vertical position, stacks of sheet material such as glass, metal, plastic and large marble plates. While the invention can be used with any sheet material, it is particularly useful for transporting sheets of fragile material. Thus, for the purpose of the present invention the term "glass sheet" will be used in the specification to refer to any sheet material to be transported.

The present invention provides, for use in packing, storing and transporting sheet material, a sheet material protecting unit including two complementary protecting elements, each including a substantially planar surface for engaging an outer surface of the sheet material and at least one coupling element for coupling the two protecting elements, so that the sheet material is held tightly between them to prevent the sheets from moving relative to one another. Preferably, the unit also includes at least one strap engaging element for engaging tying elements, such as straps, around the stack, and at least one means for coupling lift means. When, for example, four such protecting units are assembled around the corners of a rectangular stack of sheets, the sheets are held as one rigid block, and the stack can easily be lifted by a crane.

Another embodiment of the present invention discloses a sheet material protecting system including at least two modular protecting units that are assembled around a stack of sheets and means for tying these protecting units on the sheet material.

Furthermore, the present invention provides a method for packing a stack of sheet material, comprising the steps of coupling at least two protecting units about the stack, each protecting unit being formed by coupling at least one coupling element to a first protecting element; and coupling a second protecting element to said coupling element.

BRIEF DESCRIPTION OF THE DRAWINGS

The present invention will be further understood from the following detailed description taken in conjunction with the drawings in which.

DETAILED DESCRIPTION OF THE INVENTION

The present invention relates to a modular protecting system for use in packing, storing and transporting sheet material, which is comprised of a plurality of protecting units for coupling about the sheet material. The present invention is especially useful for delicate and fragile sheets that have a relatively high specific weight, such as glass (2.5 $Kg/dm^3$) and which tend to break in case of collision or shock.

Figure 1:
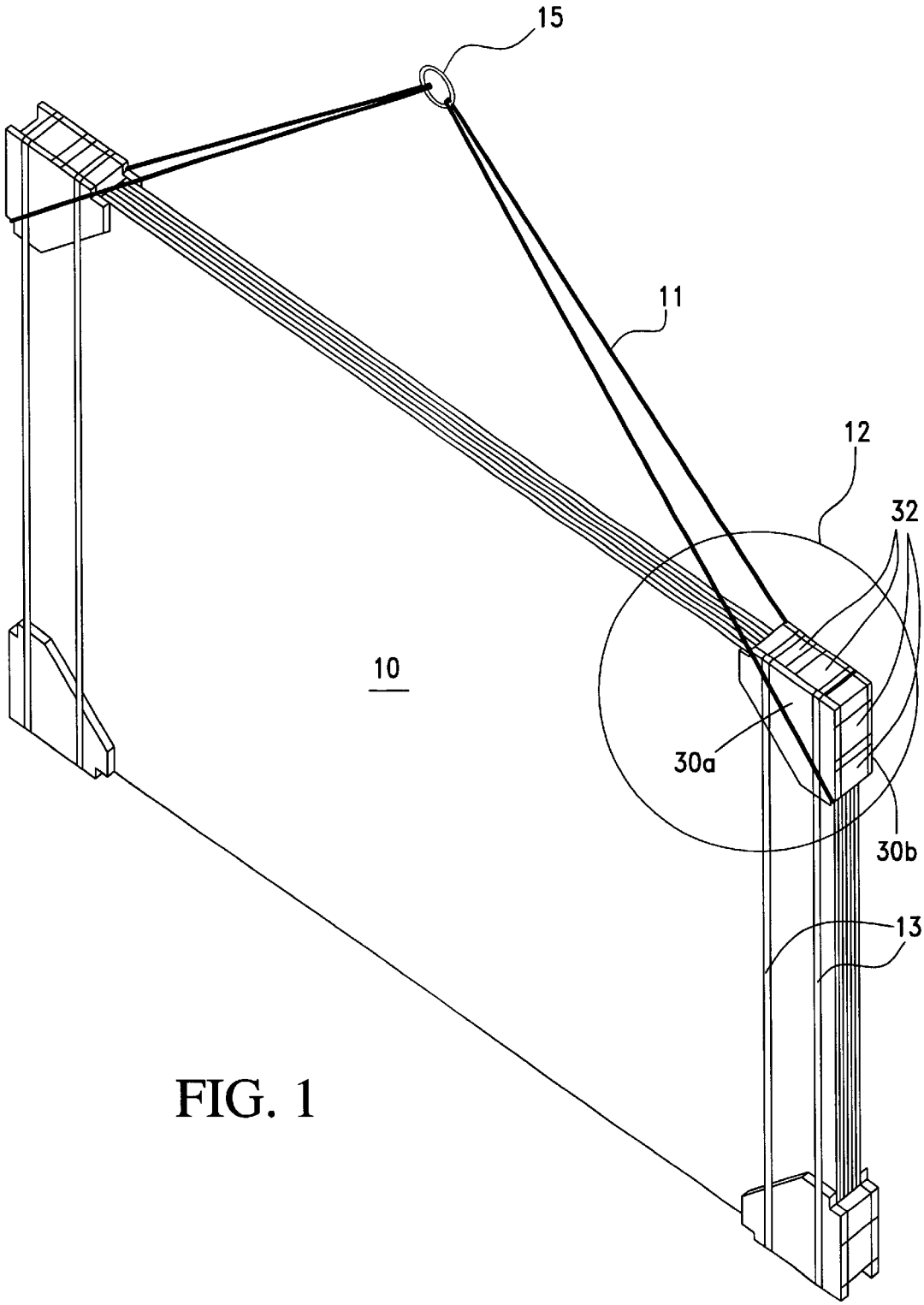
FIG. 1 is a perspective view of a packed stack of sheets in accordance with one embodiment of the system and method of packing and transporting sheet materials of the present invention.
Figure 2:
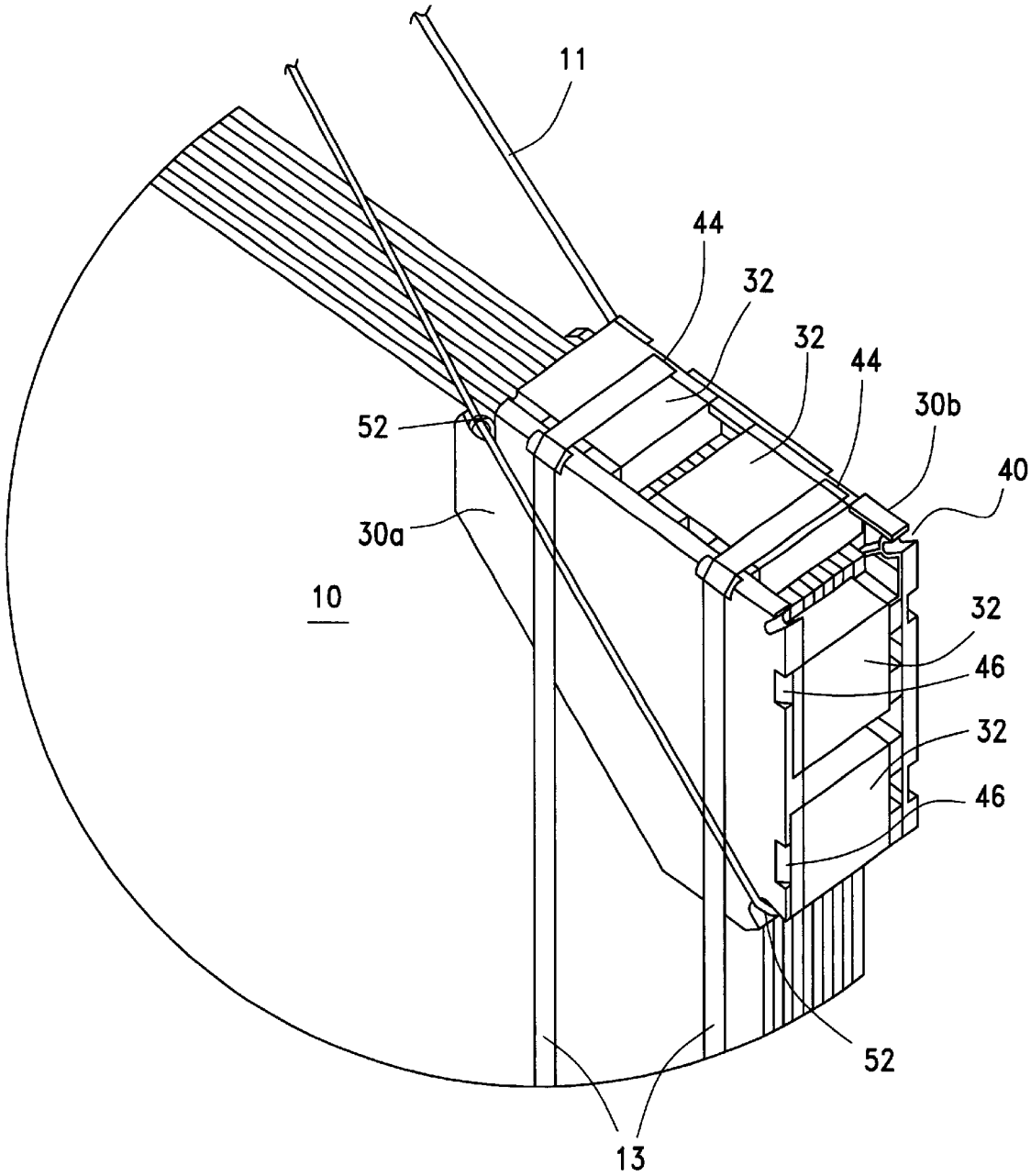
FIG. 2 is an enlarged perspective view of a modular sheet material protecting unit 12 of the system shown in FIG. 1.
Figure 6:
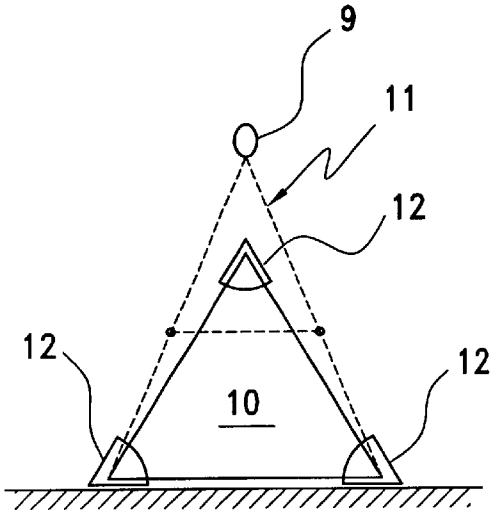
Figure 5:
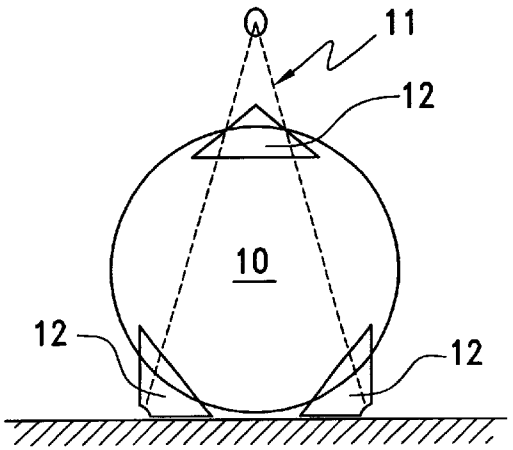

Referring now to the drawings, FIGS. 1 and 2 depict a stack of sheets 10 tightly held together by a sheet material protecting system according to one embodiment of the invention. This system is comprised of four similar sheet material protecting units 12 that are coupled to each corner of the stack. However, the system of the present invention can be comprised of less or more than four protecting units according to the users' purposes, so long as the sheets are packed in a manner that does not enable them to move relative to one another while being transported. A few possibilities of packing different shapes of stacks of sheets in accordance with the present invention are illustrated in FIGS. 5–8, by way of non-limiting example only. For example, as shown in FIG. 6, when triangular sheets are transported, three such protecting units are sufficient.

Each of these, protecting units 12 includes modular protecting elements 30*a* (front plate) and 30*b* (back plate) with projections along one or two of their sides, coupled together by at least one coupling element 32.

Figure 9:
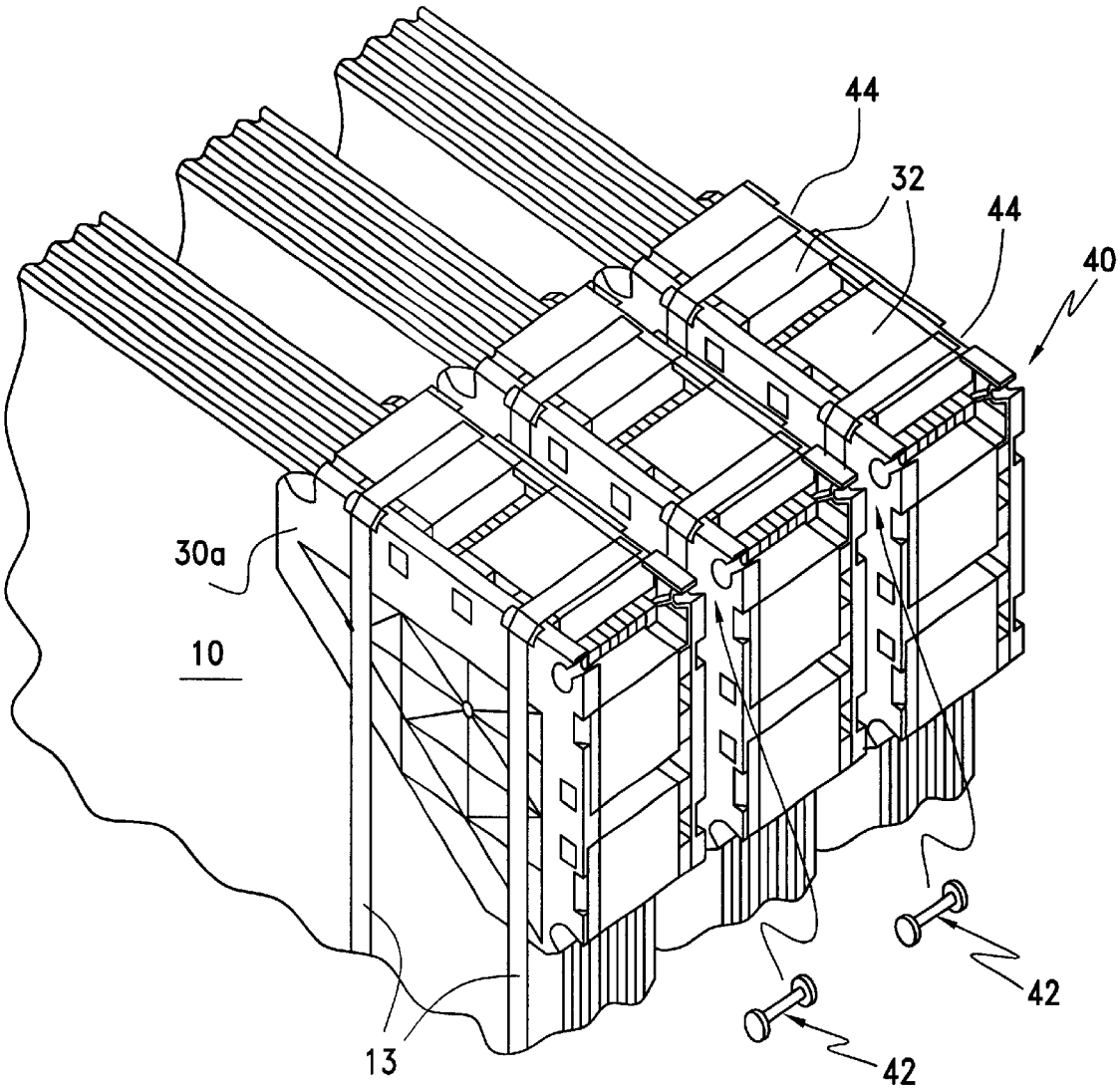
FIG. 9 is a perspective view of several packed stacks connected in accordance with the present invention.

The assembly of these elements will be described hereinafter in conjunction with FIG. 3. Two adjacent protecting units can be held in place by tying elements, such as straps 13, that are wrapped tightly around the protecting elements, as through grooves 44. The protecting elements are also provided with at least one lift engaging means 52 for engaging straps or a wire 11 in order to lift the entire stack with a hoist, a crane or a forklift or other known equipment. A groove 40 is provided at the edge of each protecting element (30*a* and 30*b*), preferably on the corner of the protecting element, as shown in FIG. 2. Groove 40 is useful for coupling two or more stacks of sheet material held by the protecting, units together by the insertion of a connecting element, such as a modular connecting-shaft 42 (as shown in FIG. 9) through grooves 40 of each two adjacent protecting units. Alternatively, instead of many modular connecting elements, an elongated bolt having two end-stoppers (not shown) can be inserted through grooves 40 of several packed stacks. In both ways, two or more stacks of sheet material are coupled so that the stacks are held tightly together. Attaching several stacks together is also useful for keeping one stack from falling away from the other stacks.

In another embodiment of the invention, groove 40 is formed on the side edge of the protecting elements between grooves 44 or 46. A person skilled in the art will appreciate that such groove can be formed in any suitable shape.

Figure 10:
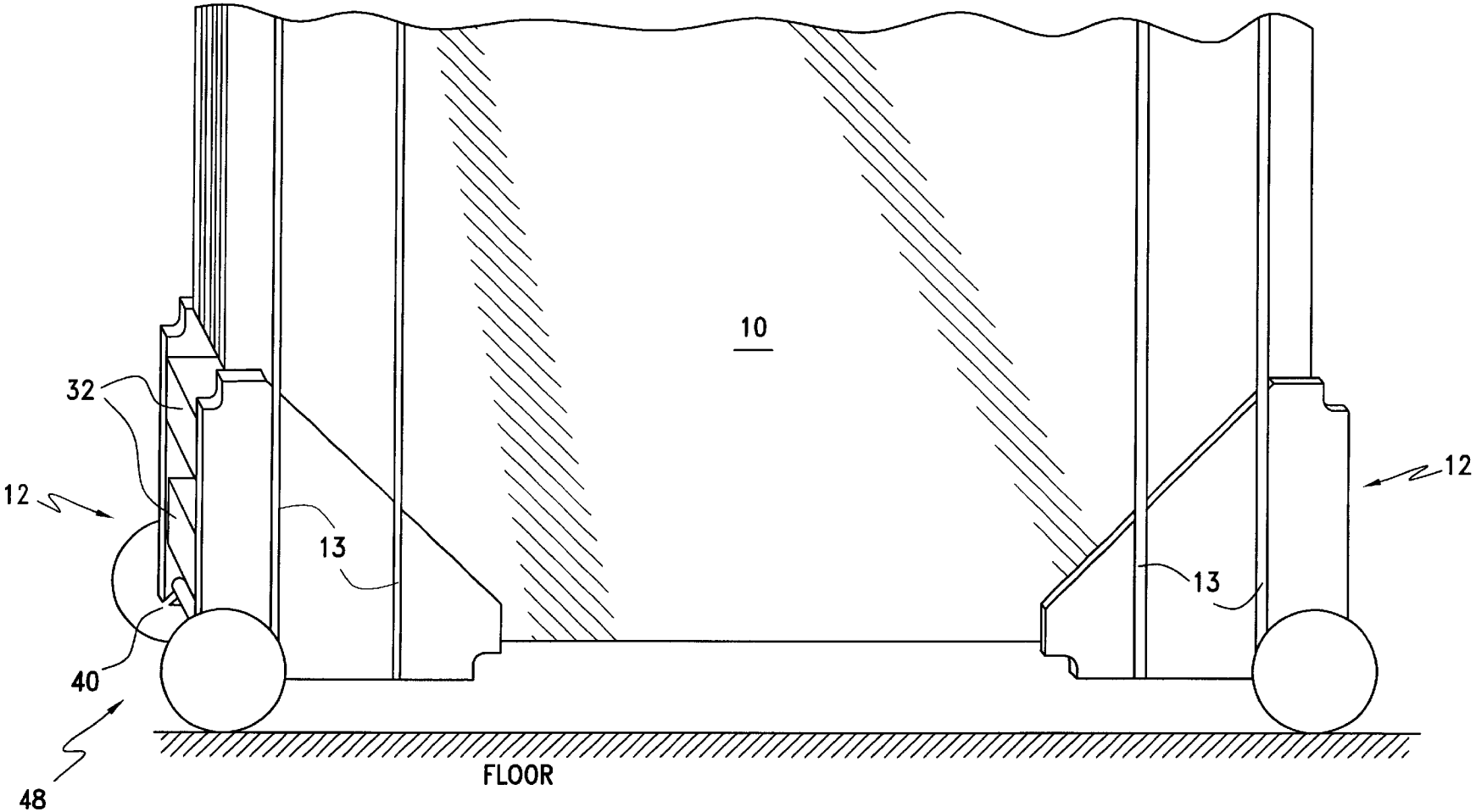
FIG. 10 is an illustration of a packed stack coupled to means for facilitating transfer thereof.

In yet another embodiment of the invention, groove 40 is designed to receive means 48 for facilitating the transfer of one or more packed stacks. Means 48 preferably includes wheels coupled to a bolt or a shaft, as shown in FIG. 10. By assembling means 48 into the grooves 40 of the lower protecting units of one or more packed stacks, one can manually propel the packed stacks around a warehouse or even on a transporter or into a marine-container, for example, without needing to carry the packed stacks by hand or lifting equipment.

The protecting units are preferably molded from polypropylene plastic. It will be appreciated that some of the elements of the unit can be also injected or extruded. Furthermore, the unit or any of its parts can be made of PVC plastic or other suitable material. One embodiment of the present invention includes protecting elements in which the substantially planar surface to be positioned on the sheet material is cushioned by means of a soft material, such as felt.

Figure 3:
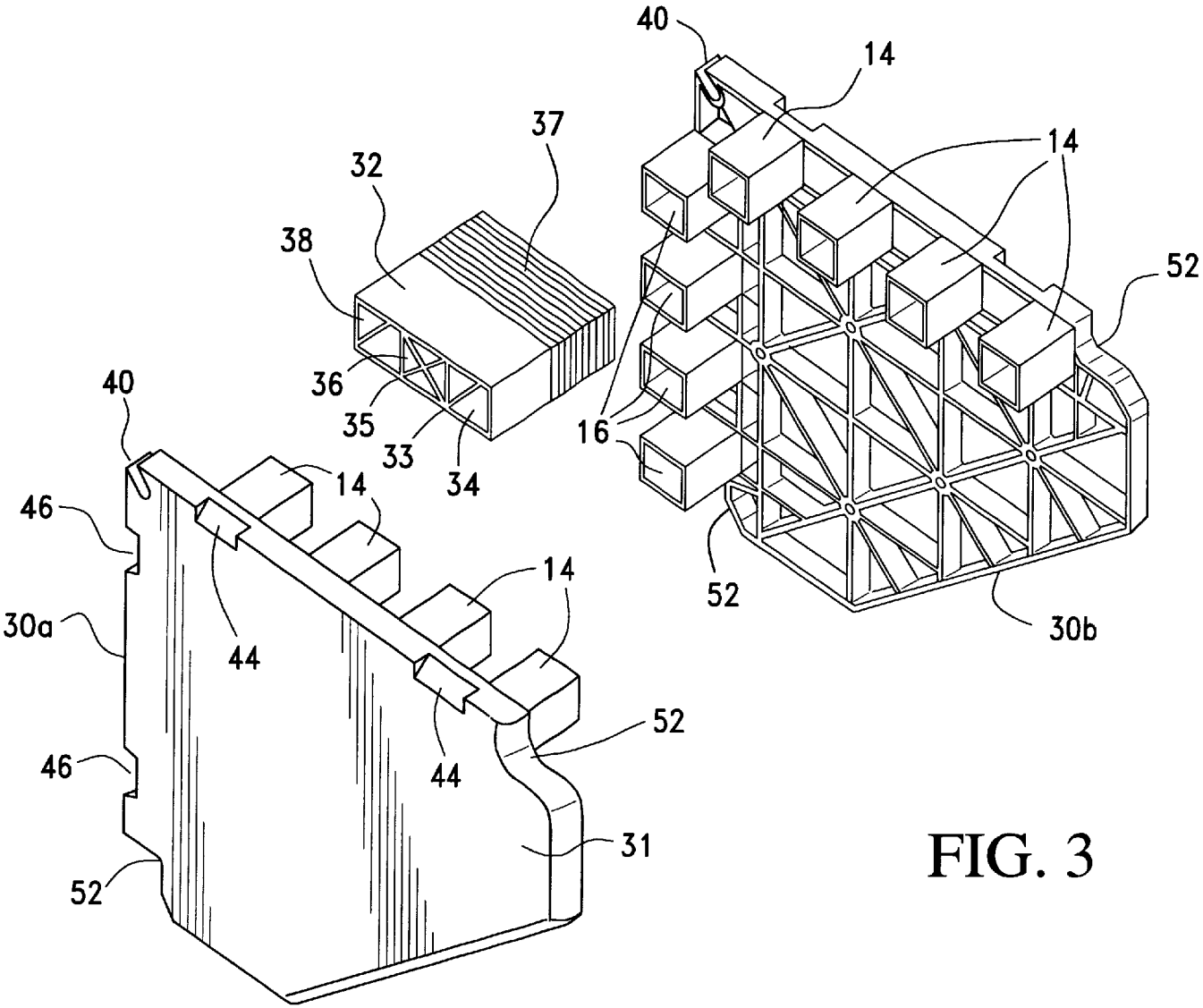
FIG. 3 is an exploded view of the modular sheet material protecting unit shown, in FIG. 2.

In FIG. 3 there is shown an exploded view of a sheet material protecting unit 12 according to one embodiment of the present invention. Unit 12 consists of two modular protecting elements 30*a* and 30*b* each including a substantially planar surface 31 for engaging a surface of the sheet material. In the embodiment of FIG. 3, planar surfaces 31 are substantially triangular. However, it will be appreciated that the shape and size can change depending on the shape, size and weight of the sheets, as shown by way of example in FIGS. 5–8. Protecting elements 30*a* and 30*b* also include a plurality of projections 14 and 16 on their sides. The planar surface can be a plain flat surface (not shown) or a reinforced surface with vertical and horizontal ribs or other configuration of ribs, for example, the configuration shown in FIG. 3, which is useful when transporting heavy stacks.

It will be appreciated that while in this preferred embodiment there are four projections in each side of the protecting element, the number of projections is changeable and depends on the weight and dimensions of the stack to be packed. Protecting elements 30*a* and 30*b*, which are substantially identical, are also provided with grooves 44 and 46 on each side and two lift engaging means 52 at opposite edges of elements 30*a* and 30*b*. According to the present invention, the protecting element is preferably provided with at least one strap engaging element for engaging tying elements, such as straps, around the stack.

Figure 4:
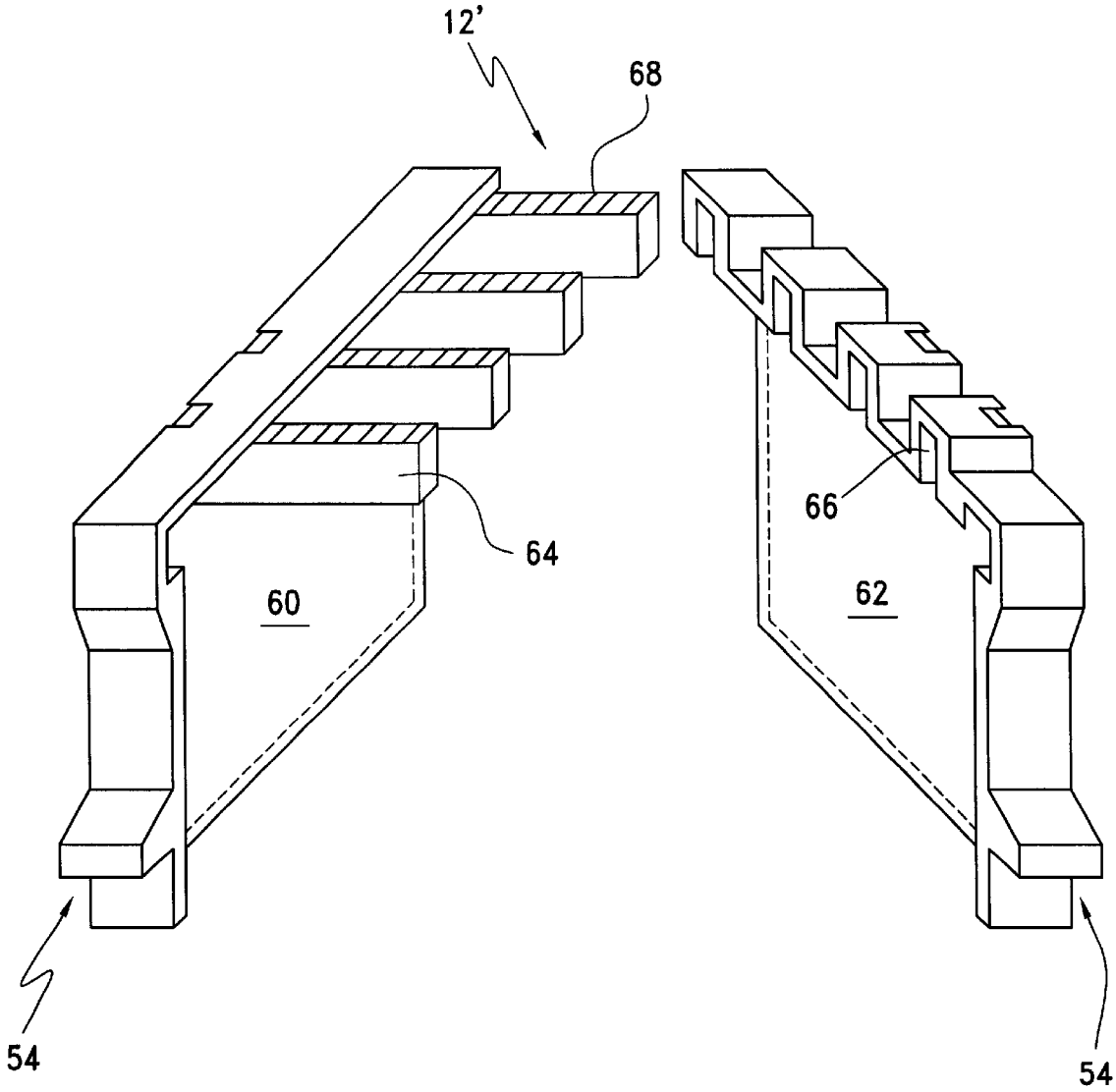
FIG. 4 is a perspective illustration of another embodiment of a modular sheet material protecting unit in accordance with the present invention.
Figure 7:
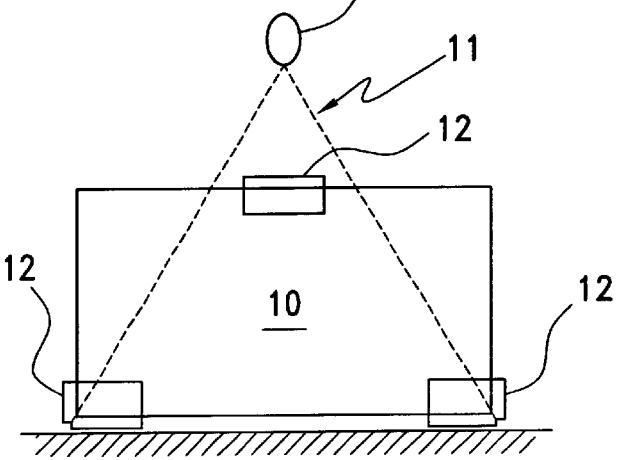
FIGS. 5–8 are illustrations of packed stacks of sheets in different shapes in accordance with additional embodiments of the system and method of packing and transporting sheet materials according to the present invention.
Figure 8:
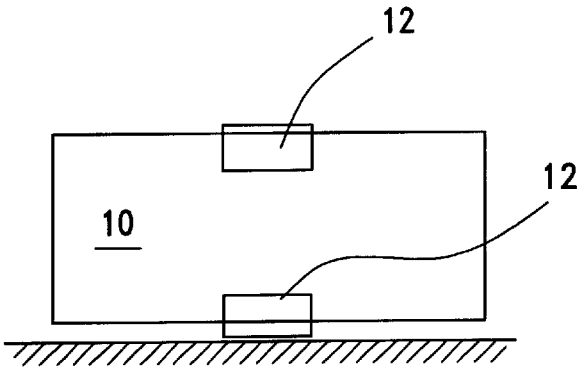

Protecting unit 12 also includes at least one lift engaging means. In the embodiment depicted in this drawing, there are two lift engaging means 52 in a form of a shoulder. Alternatively, these means can be formed as projecting extensions 54 (as seen in FIG. 4).

At least one coupling element 32 is provided for assembling elements 30*a* and 30*b* around the stack. The coupling element can be provided in a number of predetermined sizes, or as one elongate unit which can be cut to fit the desired thickness of the stack. Preferably, the coupling element is provided with cuttable notches 37 for ease of adjusting it, by the user, to the desired thickness of any stack of sheets at any time of packing. Alternatively, when coupling element 32 is produced by extrusion, the user can cut it on-line, during production, to the desired length.

In the embodiment of FIG. 3, coupling element 32 is a rectangular, hollow cubic element having partitions 33 and 35 which form bores 34, 36 and 38 therein. Preferably, the number of bores in coupling element 32 depends upon the number of projections to be engaged. Bores 34 and 38 are shaped to engage each two of the projections 14 or 16 of protecting elements 30*a* and 30*b*. Thus, element 32 can alternatively have a round shape with round bores for coupling round projections.

In the embodiment of FIG. 3, bore 36, which is not used for coupling, is reinforced with two transversed ribs. In another embodiment of the present invention bore 36 is replaced by a solid wall. Another embodiment of the present invention includes a coupling element 32 having a single bore into which two projections 14 or 16 are inserted.

At least one coupling element 32 is required on at least one side for coupling the two protecting elements 30*a* and 30*b*. It will be appreciated that the number of the required coupling elements depends upon the number of projections provided in the protecting elements which, in turn depends on the size and weight of the stack. According to an alternative embodiment of the invention, the coupling element includes a plurality of bores which corresponds to the number of projections extending from the protecting element, and thus only one coupling element is required for coupling one side of a first protecting element to a second such element. Preferably, the protecting elements are coupled in such a manner that the sheet material is held tightly to prevent the sheets from moving relative to one another and to enable lifting the sheet material as a stack.

Referring now to FIG. 4, another embodiment of the present invention is shown. Here, unit 12' consists of a pair of mating protecting elements, namely, a male element 60 having a plurality of projections 64 and a female element 62 having a plurality of sockets 66. Elements 60 and 62 are interconnected and mounted onto the edges of stack 10. The mating elements interlock in a plug and socket manner with projections 64 being received in sockets 66, after their adjustment to the desired thickness of the stack. It will be appreciated that in this embodiment, the coupling element is integrally formed with the projections of male element 60. In order to simplify the procedure of adjusting the length of projections 64 to the thickness of a desired stack, a preferred embodiment of the present invention is provided with notches 68 at the upper side of projections 64. The interval of notches 68 can be any predetermined interval. The projections can be cut at notches 68, reducing the length of the projections so that the mating sections making up the unit fit snugly against the sheets.

An alternative embodiment of the present invention includes two planar protecting elements, each having a plurality of projection receiving sockets. In this embodiment, the coupling element includes projections on each end for engaging the projections-receiving sockets on each planar element. Preferably, the length of the projections can be adjusted on each end. Yet another embodiment of the present invention includes a telescoping coupling element with snap fit.

The method of packing, storing and transporting sheet material according to the present invention is as follows, coupling at least two protecting units about the stack. Each protecting unit is formed by coupling at least one coupling element to a first protecting element, and coupling a second protecting element to the coupling element.

A preferred method of packing, storing and transporting sheet material will be now described with reference to packing a rectangular stack of glass sheets. A rectangular stack of glass sheets is positioned vertically at an angle of at 95° on a standard metal base which enables strapping the stack, where all its corners are uncovered. A plurality of protecting units are assembled and mounted around a stack. Preferably, four units 12 will be coupled to a rectangular stack of sheets, one on each corner of the stack.

The protecting units can be assembled and mounted on an edge of the stack in several ways. In one way, a first protecting element can be positioned on a surface of the stack and coupled around the stack to a second protecting element with at least one coupling element. Alternatively, a first protecting element can be coupled to at least one coupling element, then positioned on a surface of the stack and after that coupled to a second protecting element through the coupling elements. Or a first protecting element can be coupled to a second protecting element with at least one coupling element so that a protecting unit is assembled and then the protecting unit can be mounted around an edge of the stack.

During assembly, if one finds that the thickness of the stack is smaller than the length of the coupling element, the coupling element is adjusted to the desired length, as by removing the excess portion of element 32. After all protecting units are mounted on the sheet material, the stack is bound by tying elements, such as plastic straps, metal straps or cables, which are guided around the stack and protecting units, as through grooves 44 or 46 or both. Each strap is tightened around the stack manually or by pneumatic tightening equipment, as known in the art. Pressure of the protecting units on opposing surfaces of the stack causes the stack to act as one rigid block. The stack can be lifted by standard means, such as lifting cables or wires 11, or by special straps which are attached to the lift engaging means 52 on the two upper units of the protected stack.

It will be appreciated by those skilled in the art that the invention is not limited to what has been shown and described hereinabove by way of example. Rather, the scope of the invention is defined solely by the claims which follow.

What is claimed is:

1. A sheet material protecting unit for protecting a sheet material, comprising:

two protecting elements, each including a substantially planar surface for engaging a surface of the sheet material; and at least one coupling element for coupling said two protecting elements about the sheet material, wherein each of said protecting elements includes at least one coupling means along at least one side thereof, and wherein said at least one coupling element includes coupling means engaging elements.

2. A sheet material protecting unit as set forth in claim I wherein said coupling element includes a plurality of projections integrally formed along at least one side of one of said protecting elements, and a plurality of complementary projection-receiving elements formed along at least one side of the second protecting element.

3. A sheet material protecting unit according to claim 1 further comprising at least one strap engaging element for engaging strap elements around the sheet material.

4. A sheet material protecting unit according to claim 1 further comprising at least one means for coupling lift means.

5. A sheet material protecting unit according to claim 1 further comprising at least two coupling elements for coupling said two protecting elements along two sides.

6. A sheet material protecting unit according to claim 1 further comprising means for coupling two or more stacks of packed sheet material together.

7. A sheet material protecting unit as set forth in claim 1 wherein said sheet material protecting unit is made of plastic.

8. A sheet material protecting unit as set forth in claim 7 wherein said sheet material protecting unit is made of polypropylene.

9. A sheet material protecting unit as set forth in claim 1 wherein said substantially planar surface has a reinforced structure.

10. A sheet material protecting unit as set forth in claim 1 wherein said at least one coupling element is provided with cuttable notches.

11. A sheet material protecting unit as set forth in claim 1 wherein said at least one coupling element further includes at least one throughgoing bore for engaging said at least one coupling means of said protecting elements.

12. A sheet material protecting unit according to claim 1 wherein said at least one coupling element is cuttable to a desired length.

13. A sheet material protecting unit according to claim 1 wherein said coupling means comprises a plurality of projections.

14. A modular sheet material protecting system for use in packing, storing and transporting sheet material, said system comprising:

at least two sheet material protecting units according to claim 1 for mounting on said sheet material; and strap engaging element for engaging straps over said protecting units and around said sheet material.

15. A modular sheet material protecting system comprising:

at least two sheet material protecting units according to claim 1 for mounting on said sheet material;

means for coupling said protecting units to said sheet material; and means for lifting said sheet material protecting units and said sheet material.

16. A modular sheet material protecting system as in claim 15 further comprising means for coupling two or more stacks of sheet material together.

17. A modular sheet material protecting system as in claim 16 wherein said means for coupling two or more stacks of sheet material together further includes element for propelling the stacks.

18. A method for packing a stack of sheet material having a width, comprising the steps of:

coupling at least two protecting units about the stack, each protecting unit being formed by:

fitting the length of at least one coupling element by reducing its length so that it matches the width of the stack;

coupling said coupling element to a first protecting element; and coupling a second protecting element to said at least one coupling element about the stack.

19. A method for packing a stack of sheet material as set forth in claim 18 wherein said step of coupling to said first protecting element includes forming said at least one coupling element as an integral part of said first protecting element.

20. A method for packing a stack of sheet material according to claim 18 which further includes the step of positioning said first protecting element on a surface of the stack before said step of coupling a second protecting element.

21. A method for packing a stack of sheet material according to claim 18 further including the step of mounting said at least two protecting units around an edge of said stack after the step of coupling a second protecting element to said coupling element.

22. A method for packing a stack of sheet material according to claim 18 further comprising the step of removing an excess portion of said coupling element for fitting the coupling element to a desired length.

23. A method for packing a stack of sheet material as set forth in claim 18 which further includes the step of strapping the stack by tying elements which are bound around the stack and the protecting units.

24. A method for packing a stack of sheet material according to claim 18 wherein the step of fitting the coupling element to a desired width of the stack to be packed is performed after coupling said coupling element to said first protecting element.

25. A method for packing a stack of sheet material as set forth in claim 18 which further includes the step of coupling two or more stacks together through means formed on the protecting elements.

26. A method for packing a stack of sheet material according to claim 18 further comprising the step of coupling to at least one of said protecting units means for facilitating transfer of the stack.

* * * * *